US005508094A

United States Patent [19]

McCarthy et al.

[11] Patent Number: 5,508,094

[45] Date of Patent: Apr. 16, 1996

[54] PRESS FABRICS FOR PAPER MACHINES

[75] Inventors: William M. McCarthy, Rensselaer, N.Y.; Ebo E. Dam, Dieren, Netherlands; Wil F. van Bergen, Dieren, Netherlands; Keith Fitzpatrick, Dieren, Netherlands

[73] Assignee: Albany International Corp., Albany, N.Y.

[21] Appl. No.: 291,152

[22] Filed: Aug. 16, 1994

Related U.S. Application Data

[63] Continuation-in-part of Ser. No. 809,794, Dec. 18, 1991, Pat. No. 5,360,518.

[51] Int. Cl.[6] ..... D03D 3/00

[52] U.S. Cl. ..... 428/225; 139/383 R; 428/223; 428/229; 428/233; 428/245; 428/257; 428/262; 428/284

[58] Field of Search ..... 139/383 R; 428/223, 428/225, 229, 233, 257, 284, 262, 245

[56] References Cited

U.S. PATENT DOCUMENTS

| | | | |
|---|---|---|---|
| 4,224,372 | 9/1980 | Romanski | 428/257 |
| 4,261,392 | 4/1981 | Westhead | 139/383 A |
| 4,289,173 | 9/1981 | Miller | 139/383 A |
| 4,308,897 | 1/1982 | Westhead | 139/383 A |
| 4,356,225 | 10/1982 | Dufour | 428/234 |
| 4,423,755 | 1/1984 | Thompson | 139/383 A |
| 4,469,142 | 9/1984 | Harwood | 139/383 A |
| 4,503,113 | 3/1985 | Smart | 428/234 |
| 4,533,594 | 8/1985 | Buchanan | 428/236 |
| 4,784,190 | 11/1988 | Mullaney | 139/383 A |
| 4,795,480 | 1/1989 | Boyer et al. | 51/296 |
| 4,824,525 | 4/1989 | Penven | 162/358 |
| 4,863,786 | 9/1989 | Green et al. | 428/234 |
| 4,867,206 | 9/1989 | Kufferath | 139/383 A |
| 4,870,998 | 10/1989 | Westhead | 139/383 A |
| 4,902,383 | 2/1990 | Penven | 162/199 |
| 4,909,284 | 3/1990 | Kositzke | 139/383 A |
| 4,931,010 | 6/1990 | Barnewall | 428/282 |
| 4,941,514 | 7/1990 | Taipale | 139/383 A |
| 5,077,116 | 12/1991 | Lefkowitz | 428/141 |
| 5,094,719 | 3/1992 | Fry | 162/358 |
| 5,103,874 | 4/1992 | Lee | 139/383 A |
| 5,118,557 | 6/1992 | Barnewall | 428/234 |

*Primary Examiner*—James J. Bell

*Attorney, Agent, or Firm*—Kane, Dalsimer, Sullivan, Kurucz, Levy, Eisele & Richard

[57] ABSTRACT

A press fabric for use on the press section of a paper machine has a multilayer structure, and is woven according to techniques normally applied in the weaving of forming fabrics. The press fabric is woven from at least one system of warp yarns and two or more layers of weft yarns, with the yarn sizes and weave patterns chosen with a view toward providing the resulting press fabric with a fine paper-contacting surface, and ample void volume. One of the two or more layers of weft yarns includes, or is entirely composed of, multicomponent yarns having a plurality of load-bearing members. The multicomponent yarns may be multifilament or multistrand yarns composed of fine filaments, or may be polyurethane-coated monofilament yarns, and provide the press fabrics with a compressible and resilient structure. The multifilament or multistrand yarns may also be polyurethane-coated.

60 Claims, 11 Drawing Sheets

FIG. 2

| I → | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | X | • | X | • | • | X | • | • | X | • | X | • | • | X | • | • |
| 2 | X | • | X | X | • | X | • | X | X | • | X | X | • | X | • | X |
| 3 | X | • | X | X | X | X | X | X | X | • | X | X | X | X | X | X |
| 4 | X | • | • | • | • | X | • | • | X | • | • | • | • | X | • | • |
| 5 | X | • | • | X | • | X | • | • | X | • | • | X | • | X | • | • |
| 6 | X | • | X | X | • | X | X | • | X | • | X | X | • | X | X | • |
| 7 | X | X | X | X | • | X | X | X | X | X | X | X | • | X | X | X |
| 8 | X | • | • | X | • | • | • | • | X | • | • | X | • | • | • | • |
| 9 | X | • | • | X | • | • | X | • | X | • | • | X | • | • | X | • |
| 10 | X | X | • | X | • | X | X | • | X | X | • | X | • | X | X | • |
| 11 | X | X | X | X | X | X | X | • | X | X | X | X | X | X | X | • |
| 12 | • | • | • | X | • | • | X | • | • | • | • | X | • | • | X | • |
| 13 | • | X | • | X | • | • | X | • | • | X | • | X | • | • | X | • |
| 14 | X | X | • | X | X | • | X | • | X | X | • | X | X | • | X | • |
| 15 | X | X | • | X | X | X | X | X | X | X | • | X | X | X | X | X |
| 16 | • | X | • | • | • | • | X | • | • | X | • | • | • | • | X | • |
| 17 | • | X | • | • | X | • | X | • | • | X | • | • | X | • | X | • |
| 18 | • | X | • | X | X | • | X | X | • | X | • | X | X | • | X | X |
| 19 | X | X | X | X | X | • | X | X | X | X | X | X | X | • | X | X |
| 20 | • | X | • | • | X | • | • | • | • | X | • | • | X | • | • | • |
| 21 | • | X | • | • | X | • | • | X | • | X | • | • | X | • | • | X |
| 22 | • | X | X | • | X | • | X | X | • | X | X | • | X | • | X | X |
| 23 | • | X | X | X | X | X | X | X | • | X | X | X | X | X | X | X |
| 24 | • | • | • | • | X | • | • | X | • | • | • | • | X | • | • | X |
| 25 | • | • | X | • | X | • | • | X | • | • | X | • | X | • | • | X |
| 26 | • | X | X | • | X | X | • | X | • | X | X | • | X | X | • | X |
| 27 | X | X | X | • | X | X | X | X | X | X | X | • | X | X | X | X |
| 28 | • | • | X | • | • | • | • | X | • | • | X | • | • | • | • | X |
| 29 | • | • | X | • | • | X | • | X | • | • | X | • | • | X | • | X |
| 30 | X | • | X | • | X | X | • | X | X | • | X | • | X | X | • | X |
| 31 | X | X | X | X | X | X | • | X | X | X | X | X | X | X | • | X |
| 32 | • | • | X | • | • | X | • | • | • | • | X | • | • | X | • | • |
| ← I | | | | | | | | | | | | | | | | |

FIG. 4

| III | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | X | • | • | • | • | X | • | • | X | • | • | • | • | X | • | • |
| 2 | X | • | X | • | • | X | • | • | X | • | X | • | • | X | • | • |
| 3 | X | X | X | X | • | X | • | X | X | X | X | X | • | X | • | X |
| 4 | X | • | • | • | • | • | • | • | X | • | • | • | • | • | • | • |
| 5 | X | • | • | X | • | • | • | • | X | • | • | X | • | • | • | • |
| 6 | X | • | • | X | • | X | • | • | X | • | • | X | • | X | • | • |
| 7 | X | • | X | X | X | X | X | • | X | • | X | X | X | X | X | • |
| 8 | • | • | • | X | • | • | • | • | • | • | • | X | • | • | • | • |
| 9 | • | • | • | X | • | • | X | • | • | • | • | X | • | • | X | • |
| 10 | X | • | • | X | • | • | X | • | X | • | • | X | • | • | X | • |
| 11 | X | X | • | X | • | X | X | X | X | X | • | X | • | X | X | X |
| 12 | • | • | • | • | • | • | X | • | • | • | • | • | • | • | X | • |
| 13 | • | X | • | • | • | • | X | • | • | X | • | • | • | • | X | • |
| 14 | • | X | • | X | • | • | X | • | • | X | • | X | • | • | X | • |
| 15 | X | X | X | X | X | • | X | • | X | X | X | X | X | • | X | • |
| 16 | • | X | • | • | • | • | • | • | • | X | • | • | • | • | • | • |
| 17 | • | X | • | • | X | • | • | • | • | X | • | • | X | • | • | • |
| 18 | • | X | • | • | X | • | X | • | • | X | • | • | X | • | X | • |
| 19 | • | X | • | X | X | X | X | X | • | X | • | X | X | X | X | X |
| 20 | • | • | • | • | X | • | • | • | • | • | • | • | X | • | • | • |
| 21 | • | • | • | • | X | • | • | X | • | • | • | • | X | • | • | X |
| 22 | • | X | • | • | X | • | • | X | • | X | • | • | X | • | • | X |
| 23 | X | X | X | • | X | • | X | X | X | X | X | • | X | • | X | X |
| 24 | • | • | • | • | • | • | • | X | • | • | • | • | • | • | • | X |
| 25 | • | • | X | • | • | • | • | X | • | • | X | • | • | • | • | X |
| 26 | • | • | X | • | X | • | • | X | • | • | X | • | X | • | • | X |
| 27 | • | X | X | X | X | X | • | X | • | X | X | X | X | X | • | X |
| 28 | • | • | X | • | • | • | • | • | • | • | X | • | • | • | • | • |
| 29 | • | • | X | • | • | X | • | • | • | • | X | • | • | X | • | • |
| 30 | • | • | X | • | • | X | • | X | • | • | X | • | • | X | • | X |
| 31 | X | • | X | • | X | X | X | X | X | • | X | • | X | X | X | X |
| 32 | • | • | • | • | • | X | • | • | • | • | • | • | • | X | • | • |
| III | | | | | | | | | | | | | | | | |

FIG. 6

| V → | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | X | • | • | • | X | • | • | • | X | • | • | • | X | • | • | • |
| 2 | X | X | X | • | X | • | • | • | X | • | X | X | X | • | X | • |
| 3 | X | X | X | X | X | X | X | X | X | X | X | X | X | O | X | O |
| 4 | • | • | X | • | • | • | X | • | • | • | X | • | • | • | X | • |
| 5 | X | X | X | • | X | • | X | X | X | • | X | • | • | • | X | • |
| 6 | X | X | X | O | X | O | X | X | X | X | X | X | X | X | X | X |
| 7 | X | • | • | • | X | • | • | • | X | • | • | • | X | • | • | • |
| 8 | X | • | • | • | X | • | X | X | X | • | X | • | X | X | X | • |
| 9 | X | X | X | X | X | X | X | X | X | O | X | O | X | X | X | X |
| 10 | • | • | X | • | • | • | X | • | • | • | X | • | • | • | X | • |
| 11 | X | • | X | X | X | • | X | • | • | • | X | • | X | X | X | • |
| 12 | X | O | X | X | X | X | X | X | X | X | X | X | X | X | X | O |
| 13 | X | • | • | • | X | • | • | • | X | • | • | • | X | • | • | • |
| 14 | X | • | X | X | X | • | X | • | X | X | X | • | X | • | • | • |
| 15 | X | X | X | X | X | O | X | O | X | X | X | X | X | X | X | X |
| 16 | • | • | X | • | • | • | X | • | • | • | X | • | • | • | X | • |
| 17 | X | • | X | • | • | • | X | • | X | X | X | • | X | • | X | X |
| 18 | X | X | X | X | X | X | X | X | X | X | X | O | X | O | X | X |
| 19 | X | • | • | • | X | • | • | • | X | • | • | • | X | • | • | • |
| 20 | X | • | X | • | X | X | X | • | X | • | • | • | X | • | X | X |
| 21 | X | O | X | O | X | X | X | X | X | X | X | X | X | X | X | X |
| 22 | • | • | X | • | • | • | X | • | • | • | X | • | • | • | X | • |
| 23 | • | • | X | • | X | X | X | • | X | • | X | X | X | • | X | • |
| 24 | X | X | X | X | X | X | X | O | X | O | X | X | X | X | X | X |
| V → | | | | | | | | | | | | | | | | |

FIG. 9

| VIII | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | X | • | • | • | X | • | • | • | X | • | • | • | X | • | • | • |
| 2 | X | X | X | • | X | • | X | • | X | • | X | X | X | • | X | • |
| 3 | X | X | X | X | X | X | X | X | X | X | X | X | X | O | X | O |
| 4 | • | • | X | • | • | • | X | • | • | • | X | • | • | • | X | • |
| 5 | X | X | X | • | • | • | X | X | X | • | X | • | • | • | X | • |
| 6 | X | X | X | O | X | O | X | X | X | X | X | X | X | X | X | X |
| 7 | X | • | • | • | X | • | • | • | X | • | • | • | X | • | • | • |
| 8 | X | • | X | • | X | • | X | X | X | • | X | • | X | X | X | • |
| 9 | X | X | X | X | X | X | X | X | X | O | X | O | X | X | X | X |
| 10 | • | • | X | • | • | • | X | • | • | • | X | • | • | • | X | • |
| 11 | • | • | X | X | X | • | X | • | • | • | X | • | X | X | X | • |
| 12 | X | O | X | X | X | X | X | X | X | X | X | X | X | X | X | O |
| 13 | X | • | • | • | X | • | • | • | X | • | • | • | X | • | • | • |
| 14 | X | • | X | X | X | • | X | • | X | X | X | • | X | • | X | • |
| 15 | X | X | X | X | X | O | X | O | X | X | X | X | X | X | X | X |
| 16 | • | • | X | • | • | • | X | • | • | • | X | • | • | • | X | • |
| 17 | X | • | X | • | • | • | X | • | X | X | X | • | • | • | X | X |
| 18 | X | X | X | X | X | X | X | X | X | X | X | O | X | O | X | X |
| 19 | X | • | • | • | X | • | • | • | X | • | • | • | X | • | • | • |
| 20 | X | • | X | • | X | X | X | • | X | • | X | • | X | • | X | X |
| 21 | X | O | X | O | X | X | X | X | X | X | X | X | X | X | X | X |
| 22 | • | • | X | • | • | • | X | • | • | • | X | • | • | • | X | • |
| 23 | • | • | X | • | X | X | X | • | • | • | X | X | X | • | X | • |
| 24 | X | X | X | X | X | X | X | O | X | O | X | X | X | X | X | X |
| VIII | | | | | | | | | | | | | | | | |

FIG. 11

| X→ | 1 | 2 | 3 | 4 | 5 | 6 | 7 | 8 | 9 | 10 |
|---|---|---|---|---|---|---|---|---|---|---|
| 1 | X | • | • | • | • | X | • | • | • | • |
| 2 | X | X | X | X | O | X | X | X | X | O |
| 3 | X | • | • | X | • | X | • | • | X | • |
| 4 | • | • | • | X | • | • | • | • | X | • |
| 5 | X | X | O | X | X | X | X | O | X | X |
| 6 | • | X | • | X | • | • | X | • | X | • |
| 7 | • | X | • | • | • | • | X | • | • | • |
| 8 | O | X | X | X | X | O | X | X | X | X |
| 9 | • | X | • | • | X | • | X | • | • | X |
| 10 | • | • | • | • | X | • | • | • | • | X |
| 11 | X | X | X | O | X | X | X | X | O | X |
| 12 | • | • | X | • | X | • | • | X | • | X |
| 13 | • | • | X | • | • | • | • | X | • | • |
| 14 | X | O | X | X | X | X | O | X | X | X |
| 15 | X | • | X | • | • | X | • | X | • | • |
| 16 | X | • | • | • | • | X | • | • | • | • |
| 17 | X | X | X | X | O | X | X | X | X | O |
| 18 | X | • | • | X | • | X | • | • | X | • |
| 19 | • | • | • | X | • | • | • | • | X | • |
| 20 | X | X | O | X | X | X | X | O | X | X |
| 21 | • | X | • | X | • | • | X | • | X | • |
| 22 | • | X | • | • | • | • | X | • | • | • |
| 23 | O | X | X | X | X | O | X | X | X | X |
| 24 | • | X | • | • | X | • | X | • | • | X |
| 25 | • | • | • | • | X | • | • | • | • | X |
| 26 | X | X | X | O | X | X | X | X | O | X |
| 27 | • | • | X | • | X | • | • | X | • | X |
| 28 | • | • | X | • | • | • | • | X | • | • |
| 29 | X | O | X | X | X | X | O | X | X | X |
| 30 | X | • | X | • | • | X | • | X | • | • |

X→

PRESS FABRICS FOR PAPER MACHINES

CROSS-REFERENCE TO RELATED APPLICATION

This application is a continuation-in-part (CIP) of U.S. patent application Ser. No. 07/809,794, filed Dec. 18, 1991 now U.S. Pat. No. 5,360,518

BACKGROUND OF THE INVENTION

1. Field of the Invention

The present invention relates to a press fabric for use on the press section of a paper machine. Specifically, it relates to a press fabric, including several embodiments thereof, which is manufactured according to the techniques used to weave forming fabrics, and which has an extremely fine surface formed predominantly by fine monofilament or multicomponent yarns.

2. Description of the Prior Art

The press section of a paper machine generally includes at least one press designed to remove water from a fibrous web, which is a nascent paper sheet. Each such press includes a press nip, which is a region of elevated compression, to squeeze water from the fibrous web. The press nip itself may be formed between two adjacent press rolls. Alternatively, according to a more modern press design, the press nip may be formed between a press roll and an arcuate pressure shoe having a cylindrically concave surface of radius substantially equal to that of the press roll. A press nip formed in this manner is several times longer, in a machine, or longitudinal, direction than one formed between two press rolls. Such is the origin of the terminology commonly used by those skilled in the art to refer to this variety of press—the extended nip press.

Those in the papermaking industry are continually seeking ways to provide a quality paper product more efficiently and economically. In particular, paper manufacturers are continually striving to reduce the energy costs which accompany paper production. These costs arise because steam is normally provided to heat, from within, the series of rotatable dryer cylinders which make up the dryer section, a final stage in a paper machine. It is in the dryer section that the water remaining in the fibrous web, upon it exit from the press section, is removed by evaporation by passing the web around each in a series of dryer cylinders The less water that remains in the fibrous web leaving the press section, the less water will have to be removed by evaporation in the dryer section, and, as a consequence, the lower will be the costs associated with the production of steam for that section.

The present invention is directed to this need to remove more water from the fibrous web in the press section, thereby leaving less to be removed in the dryer section. As previously noted, water is removed from the fibrous web in the press section by passing the web through at least one press nip. More particularly, the fibrous web passes through the nip in conjunction with at least one press fabric, which support it in its still fragile condition, and which accepts the water squeezed therefrom in the nip. Commonly, the fibrous web passes through the press nip sandwiched between two such press fabrics.

It is a goal, then, of the present invention, to bring about an increase in the amount of water removed from the fibrous web in the press section by increasing the water-handling ability of the press fabrics used thereon. It is a further goal to increase the water-handling ability of the press fabrics to such a degree that the speed of the paper machine may be increased without sacrificing the structural integrity or degree of dryness of the fibrous web leaving the press section en route to the dryer section.

SUMMARY OF THE INVENTION

The present invention is a press fabric manufactured according to the techniques used to weave forming fabrics. Described in broad terms, it is a fabric having two or more woven layers formed by weaving at least one system of fine monofilament warp yarns with at least two layers of weft yarns, one of which includes a multicomponent yarn having a plurality of load-bearing members. The multicomponent yarn may be multifilament or multistrand yarn, whose individual component are fine filaments, or a polyurethane-coated monofilament yarn. The multistrand yarn may be described as and understood to be an untwisted multifilament yarn. The multifilament or multistrand yarns may also be polyurethane-coated. The press fabric has a compressible, yet resilient, structure having an extremely fine paper-contacting surface with a high contact area, and an open backside to provide sufficient void volume and the desired increased water-handling ability.

The press fabric may have at most three layers of weft yarns. Alternatively, the press fabric may be woven such that the layer of weft yarns which includes the multicomponent yarns is not a top, paper-contacting layer of the fabric.

The press fabrics of the present invention may be either woven endless, woven open-ended and joined into endless form with a woven seam, or manufactured open-ended so as to be pintle-seamed during installation on the paper machine. Further, the press fabrics may be used on the press section of a paper machine as woven, that is, as a base fabric alone, or, following weaving, may be coated with a polymeric resin material, laminated with a polymeric resin foam or other nonwoven material, or needled with a batt of fibrous material, on the paper-contacting surface thereof. Lamination, coating and needling all have application on the present woven press fabric. While the woven press fabric itself may be used on many press positions, it would not be suitable for all press types. On some suction-type presses, such as pickup positions, it is necessary to provide a press fabric with lower void volume and permeability than is possible with only the woven press fabric. The three methods of applying additional material each enable the press fabric to generate a pressure drop sufficient to facilitate dewatering. The methods also provide the press fabric with increased compression and energy absorbing characteristics.

The present invention will now be more particularly set forth by describing several embodiments thereof, with reference being made at the appropriate time to each of the several figures identified below.

BRIEF DESCRIPTION OF THE DRAWINGS

FIG. 2 is the pattern showing the relationship of the warp and weft yarns of the embodiment according to FIG. 1.

FIG. 4 is the pattern showing the relationship of the warp and weft yarns of the embodiment according to FIG. 3.

FIG. 6 is the pattern showing the relationship of the warp and weft yarns of the embodiments according to FIGS. 5 and 7.

FIG. 9 is the pattern showing the relationship of the warp and weft yarns of the embodiment according to FIG. 8.

FIG. 11 is the pattern showing the relationship of the warp and weft yarns of the embodiment according to FIG. 10.

DETAILED DESCRIPTION OF THE PREFERRED EMBODIMENT

Before describing in detail several embodiments of the press fabrics of the present invention, as depicted in the figures identified above, some general comments, applicable to all embodiments, are appropriate.

The press fabrics of the present invention are multilayered structures woven from at least one system of fine monofitament warp yarns and at least two layers of weft yarns. At least one of the two or more layers of weft yarns includes, or is entirely composed of, multicomponent yarns having a plurality of load-bearing members. These yarns provide the press fabrics of the invention with a compressible, yet resilient, structure. The so-called multicomponent layer may be any one of the two or more weft layers. It is a general characteristic of all embodiments of the present invention that a layer containing, all or in part, multicomponent yarns is captured, or interwoven with, monofilament yarns.

An example of the multicomponent yarns included in the multicomponent layer is a multifilament yarn comprising eight strands of 0.10 mm (4 mil) filament twisted together, as set forth in the examples to follow hereinbelow.

In general, the multicomponent yarn includes a plurality of load-bearing members, as does this eight-stranded multifilament yarn. Broadly stated, the multicomponent yarn may be a multifilament or multistrand yarn, whose individual components are fine filaments, or a polyurethane-coated monofilament yarn. A multistrand yarn may be considered to be equivalent to an untwisted multifilament yarn. The multifilament or multistrand yarns may also be polyurethane-coated.

The monofilament warp yarns may be either polyamide or polyester yarns. On the other hand, the monofilament weft, or shute, yarns, and the multicomponent weft yarns, exclusive of any polyurethane coating, must all be polyamide yarns to avoid problems that would be otherwise encountered during the installation of the fabric on a paper machine. Polyamide material is preferred over polyester in being less prone to fibrillation as a result of press nip compressions, and less prone to damage during needling. The polyamide weft yarn also leaves the fabric less stiff, and less likely to be creased during installation. As a consequence, the press fabrics of the present invention will be woven predominantly from polyamide yarns.

In all embodiments of the present invention, the use of larger diameter yarns in the weft layers below the paper-contacting surface, together with the weave patterns chosen, provide the press fabrics with open back, or machine, sides and sufficient void volume to accept increased quantities of water from the fibrous web.

Having made the preceding general introductory comments, several embodiments of the press fabric of the present invention will now be considered separately and in detail below.

Embodiment 1

Figure 1:
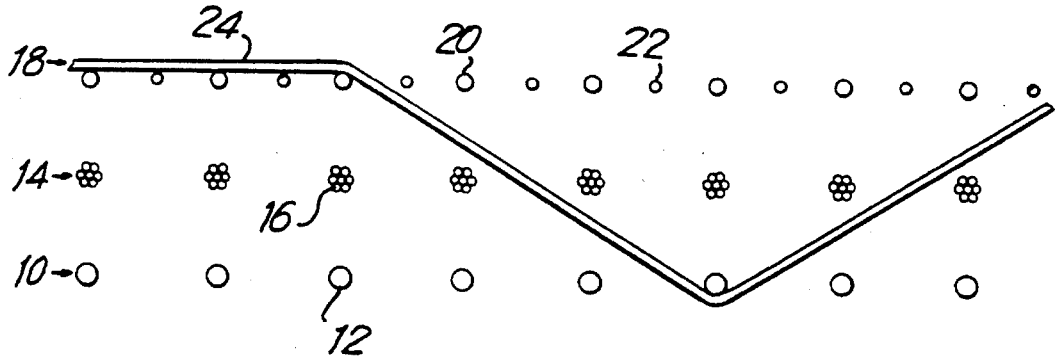
FIG. 1 is a longitudinal cross-section of a first embodiment of the present invention, wherein said cross-section has been taken along line I—I in FIG. 2.

A first embodiment of the present invention is illustrated in longitudinal cross section in FIG. 1. Here, and in all subsequent figures showing cross sections of embodiments of the present invention, the amount of separation between the yarns and layers of the fabric has been greatly exaggerated for the sake of clarity. In an actual fabric, weft yarns in each layer, and adjacent layers themselves, would be in substantial contact with one another, except for the spaces brought about therebetween by the interweaving of warp yarns between the layers. This interweaving gives rise to spaces within the fabric for the passage and temporarily storage of water.

With more particular reference now to FIG. 1, the press fabric shown there in cross-section comprises three layers of weft yarns interwoven with one system of warp yarns. The bottom layer 10 comprises monofilament yarns 12. The middle layer 14 comprises multifilament yarns 16. The top, or paper-contacting, layer 18 comprises monofilament yarns 20, 22, which alternate with one another and which are of different cross-sectional diameter.

Monofilament yarns 20 of the top layer 18, multifilament yarns 16 of the middle layer 14, and monofilament yarns 12 of the bottom layer 10 are in a vertically stacked relationship with one another through the thickness of the fabric, and therefore are provided in equal numbers on each layer. Monofilament yarns 22 of the top layer 18 alternate with monofilament yarns 20, providing the top layer 18 with twice as many weft yarns as the middle layer 14 or the bottom layer 10.

The fabric is woven in an 8-shed weave as illustrated in FIG. 1 by characteristic warp yarn 24. In any given repeat of the weave pattern, warp yarns 24 passes over three consecutive weft yarns 20 of the top layer 18, then passes obliquely downward through the middle layer 14 between the following two multifilament yarns 16 thereof, and under the third monofilament yarn 12 of the bottom layer 10, then passes obliquely upward through the middle layer 14 between the following two multifilament yarns 16 thereof to finally weave over the next monofilament yarn 20 of the top layer 18 to repeat the pattern.

FIG. 2 is a weave chart for the embodiment shown in FIG. 1, which is a cross-sectional view taken along line I—I thereof. In this, and all subsequent, weave chart, the letter "X" indicates that the warp yarn, represented by the columns in the chart, crosses over the weft yarn, represented by the rows in the chart. A dot (".") indicates that the warp yarn passes under the weft yarn with which it is crossed. Where it may happen to appear in subsequent weave charts in the present specification, the letter "o" indicates that the warp yarn weaves under a weft yarn in the bottommost layer of the fabric.

For a specific example of the embodiment shown in FIG. 1, a fabric may be woven according to the weave chart shown in FIG. 2 with yarns selected as follows:

| | |
|---|---|
| weft monofilament yarns 12 | .22 mm polyamide |
| weft multifilament yarns 14 | 8 × .10 mm polyamide |
| weft monofilament yarns 20 | .17 mm polyamide |
| weft monofilament yarns 22 | .12 mm polyamide |
| warp monofilament yarns 24 | .17 mm polyester (56 ends/cm) |

The flat weaving of the fabrics of the present invention with 56 ends/cm may be regarded as typical. Actually, the warp density falls in a range from a minimum of 40 ends/cm to a maximum of 70 ends/cm. Other yarn densities would apply if the fabrics are woven endless.

As may be observed, the top, or paper-contacting, layer 18 of this embodiment is of fine monofilament yarns, and provides an extremely fine surface with high contact area.

Embodiment 2

Figure 3:
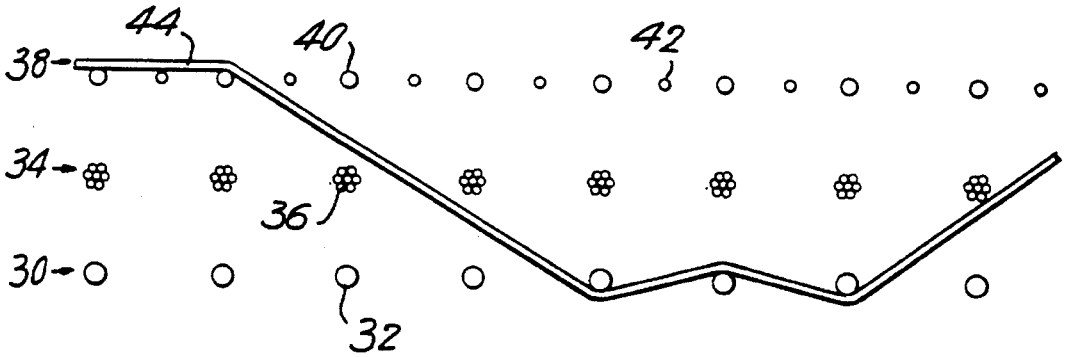
FIG. 3 is a longitudinal cross-section of a second embodiment of the present invention, wherein said cross-section has been taken along line III—III in FIG. 4.

A second embodiment of the present invention is substantially the same as the first embodiment, and is illustrated in longitudinal cross section in FIG. 3. Again, the press fabric shown comprises three layers of weft yarns interwoven with one system of warp yarns. The bottom layer 30 comprises monofilament yarns 32. The middle layer 34 comprises multifilament yarns 36. The top, or paper-contacting, layer 38 comprises monofilament yarns 40, 42, which alternate with one another and which are of different cross-sectional diameter.

Monofilament yarns 40 of the top layer 38, multifilament yarns 36 of the middle layer 34, and monofilament yarns 32 of the bottom layer 30 are in a vertically stacked relationship with one another through the thickness of the fabric, and therefore are provided in equal numbers on each layer. Monofilament yarns 42 of the top layer 38 alternate with monofilament yarns 40, providing the top layer 38 with twice as many weft yarns as the middle layer 34 or the bottom layer 30.

The fabric is again woven in an 8-shed weave as illustrated in FIG. 3 by characteristic warp yarn 44. In any given repeat of the weave pattern, warp yarn 44 passes over two consecutive weft yarns 40 of the top layer 38, then passes obliquely downward through the middle layer 34 between the following two multifilament yarns 36 thereof, under the third monofilament yarn 32 of the bottom layer 30, over and under the next two monofilament yarns 32 of the bottom layer 30, then passes obliquely upward through the middle layer 34 between the following two multifilament yarns 36 thereof to finally weave over the monofilament yarn 40 of the top layer 38 directly over the second of the last two multifilament yarns 36 to repeat the pattern.

FIG. 4 is a weave chart for the embodiment shown in FIG. 3, which is a cross-sectional view taken along line III—III thereof.

For a specific example of the embodiment shown in FIG. 3, a fabric may be woven according to the weave chart shown in FIG. 4 with yarns selected as follows:

| | |
|---|---|
| weft monofilament yarns 32 | .30 mm polyamide |
| weft multifilament yarns 34 | 8 × .10 mm polyamide |
| weft monofilament yarns 40 | .17 mm polyamide |
| weft monofilament yarns 42 | .12 mm polyamide |
| warp monofilament yarns 44 | .17 mm polyester (56 ends/cm) |

Again, in this second embodiment, the top, or paper-contacting, layer 38 is of fine monofilament yarns, and provides an extremely fine surface with high contact area.

Embodiment 3

Figure 5:
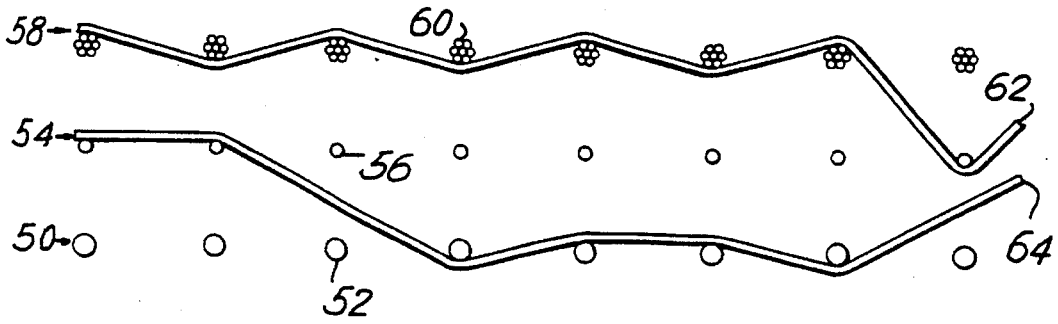
FIG. 5 is a longitudinal cross-section of a third embodiment of the present invention, wherein said cross-section has been taken along line V—V in FIG. 6.

A third embodiment of the present invention is illustrated in longitudinal cross-section in FIG. 5. The press fabric shown there in cross-section comprises three layers of weft yarns interwoven with two systems of warp yarns. The bottom layer 50 comprises monofilament yarns 52. The middle layer 54 comprises monofilament yarns 56. The top, or paper-contacting, layer 58 comprises multifilament yarns 60.

Multifilament yarns 60 of the top layer 58, monofilament yarns 56 of the middle layer 54, and monofilament yarns 52 of the bottom layer 50 are in a vertically stacked relationship with one another through the thickness of the fabric and therefore are provided in equal numbers on each layer.

The fabric is woven in an 8-shed weave as illustrated in FIG. 5 with two systems of warp yarns. A top system of warp yarns, one of which is warp yarn 62 in FIG. 5, interweaves with multifilament yarns 60 of the top layer 58 in what may be described as a plain weave modified to the extent that each warp yarn 62 weaves under every eighth monofilament yarn 56 of the middle layer 54 in a repeating pattern to bind the top layer 58 to the middle layer 54.

A bottom system of warp yarns, one of which is warp yarn 64 in FIG. 5, interweaves with monofilament yarns 56 of the middle layer 54 and monofilament yarns 52 of the bottom layer 50 in what may be characterized as a duplex weave. In any given repeat of the weave pattern, warp yarn 64 passes over two consecutive weft yarns 56 of the middle layer 54, then passes obliquely downward between the next stacked pair of weft yarn 56 of the middle layer 54 and weft yarn 52 of the bottom layer 50, weaves under the next weft yarn 52 of the bottom layer 50, over the next two weft yarns 52 and under the next weft yarn 52, and then, finally, obliquely upward between the following stacked pair of weft yarn 56 and weft yarn 52 to weave over the next weft yarn 56, beginning the pattern anew.

FIG. 6 is a weave chart for the embodiment shown in FIG. 5, which is a cross-sectional view taken along line V—V thereof. Column 1 in the weave chart shown in FIG. 6 indicates the pattern for warp yarn 62 in FIG. 5. Generally, the odd-numbered columns indicate the patterns for the top system of warp yarns, while the even-numbered columns do so for the bottom system of warp yarns. One of these latter warp yarns, warp yarn 64 in FIG. 5, is indicated by column 2 in FIG. 6. As noted earlier, the letters "o" in the even-numbered columns indicate those points where the warp yarns of the bottom layer, such as warp yarn 64, weave under a weft yarn 52 of the bottom layer 50.

For a specific example of the embodiment shown in FIG. 5, a fabric may be woven according to the weave chart shown in FIG. 6 with yarns selected as follows:

| | |
|---|---|
| weft monofilament yarns 52 | .22 mm polyamide |
| weft monofilament yarns 56 | .17 mm polyamide |
| weft multifilament yarns 60 | 8 × .10 mm polyamide |
| warp monofilament yarns 62 | .17 mm polyester |
| warp monofilament yarns 64 | .17 mm polyester |
| | (56 ends/cm total) |

As may be observed, the top, or paper-contacting, layer 58 of this embodiment may be characterized in that each weft yarn 60 is a multifilament yarn 60.

Embodiment 4

Figure 7:
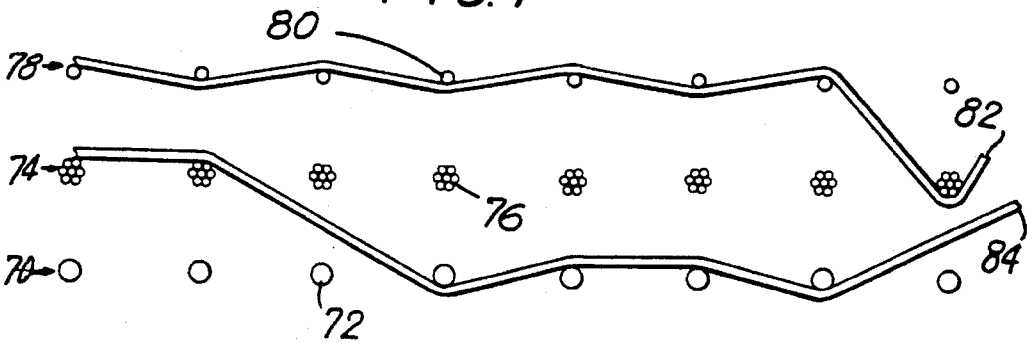
FIG. 7 is a longitudinal cross-section of a fourth embodiment of the present invention, wherein said cross-section has been taken along line V—V in FIG. 6.

A fourth embodiment of the present invention is illustrated in longitudinal cross-section in FIG. 7. This fourth embodiment is identical to the third embodiment, except that the layer of multifilament weft yarns is the middle layer rather than the top layer.

The press fabric shown in cross-section in FIG. 7 again comprises three layers of weft yarns interwoven with two systems of warp yarns. The bottom layer 70 comprises monofilament yarns 72. The middle layer 74 comprises multifilament yarns 76. The top, or paper-contacting, layer 78 comprises monofilament yarns 80.

Monofilament yarns 80 of the top layer 78, multifilament yarns 76 of the middle layer 74, and monofilament yarns 72 of the bottom layer 70 are again in a vertically stacked relationship with one another through the thickness of the fabric and therefore are provided in equal numbers on each layer.

The fabric is woven in an 8-shed weave as illustrated in FIG. 7 with two systems of warp yarns. One may readily observe that the weave pattern for the fabric shown in FIG. 7 is the same as that for the fabric shown in FIG. 5. Accordingly, the top system of warp yarns, one of which is warp yarn 82 in FIG. 7, and the bottom system of warp yarns, one of which is warp 84, weave in patterns identical to those previously described for the warp yarns of the third embodiment of the present invention. It follows that FIG. 6 is also the weave chart for the embodiment shown in FIG. 7, which is again a cross-sectional view taken along line V—V thereof.

For a specific example of the embodiment shown in FIG. 7, a fabric may be woven according to the weave chart shown in FIG. 6 with yarns selected as follows:

| | |
|---|---|
| weft monofilament yarns 72 | 0.22 mm polyamide |
| weft multifilament yarns 76 | 8 × .10 mm polyamide |
| weft monofilament yarns 80 | 0.17 mm polyamide |
| warp monofilament yarns 82 | 0.17 mm polyester |
| warp monofilament yarns 84 | 0.17 mm polyester |
| | (56 ends/cm total) |

As may be observed, the multifilament weft yarns in this fourth embodiment are in the middle layer, and are used to bind the top layer to the middle layer.

Embodiment 5

Figure 8:
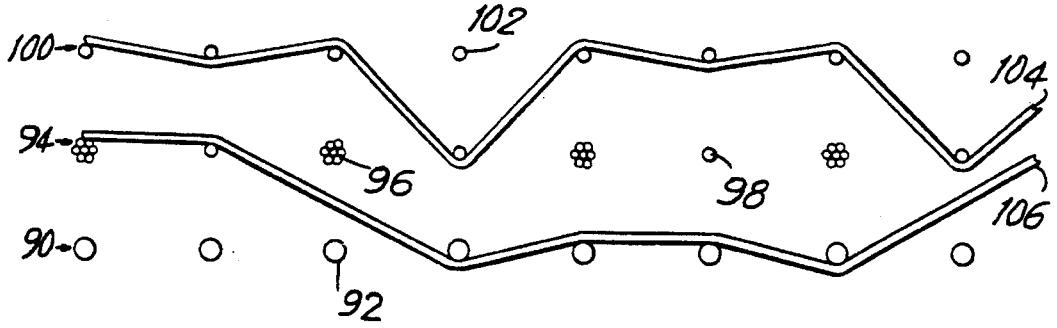
FIG. 8 is a longitudinal cross-section of a fifth embodiment of the present invention, wherein said cross-section has been taken along line VIII—VIII in FIG. 9.

A fifth embodiment of the present invention is illustrated in longitudinal cross-section in FIG. 8. The press fabric shown there comprises three layers of weft yarns interwoven with two systems of warp yarns. The bottom layer 90 comprises monofilament yarns 92. The middle layer 94 comprises multifilament yarns 96 and monofilament yarns 98, which alternate with one another. The top, or paper-contacting, layer 100 comprises monofilament yarns 102.

Monofilament yarns 102 of the top layer 100 multifilament yarns 96 and monofilament yarns 98 of the middle layer 94, and monofilament yarns 92 of the bottom layer 90 are in a vertically stacked relationship with one another through the thickness of the fabric, and therefore are provided in equal numbers on each layer. The middle layer 94 is half multifilament yarns 96 and half monofilament yarns 98, which alternate with one another as previously stated. The total number of weft yarns in middle layer 94 is the same as that in the bottom layer 90 and in the top layer 100.

The fabric is woven in an 8-shed weave as illustrated in FIG. 8 with two systems of warp yarns. A top system of warp yarns, one of which is warp yarn 104 in FIG. 8 interweaves with monofilament yarns 102 of the top layer 100 in what may be described as a plain weave, modified to the extent that each warp yarn 104 weaves under every other monofilament yarn 98 of the middle layer 94 in a repeating pattern to bind the top layer 100 to the middle layer 94. Generally stated, the warp yarns of the top system in this fifth embodiment bind only with the monofilament yarns in the middle layer to join the top and middle layers, and do not bind with the multifilament yarns of the middle layer. In comparison to the embodiments shown in FIGS. 5 and 7, the top layer 100 is bound to the middle layer 94 at twice as many points in this fifth embodiment.

A bottom system of warp yarns, one of which is warp yarn 106 in FIG. 8 interweaves with multifilament yarns 96 and monofilament yarns 98 of the middle layer 94 and with monofilament yarns 92 of the bottom layer 90 in what may be characterized as a duplex weave. Warp yarn 106, and all other warp yarns in the bottom system of warp yarns of this embodiment, weave in a pattern identical to that previously described for the warp yarns of the bottom systems of the third and fourth embodiments.

FIG. 9 is a weave chart for the embodiment shown in FIG. 8, which is cross-sectional view taken along line VIII—VIII thereof. Column 1 in the weave chart shown in FIG. 9 indicates the pattern for warp yarn 104 in FIG. 8. As was the case with FIG. 6, the odd-numbered columns in FIG. 9 indicate the patterns for the top system of warp yarns, while the even-numbered columns do so for the bottom system of warp yarns. One of these latter yarns, warp yarn 106 in FIG. 8, is indicated by column 2 in FIG. 9.

For a specific example of the embodiment shown in FIG. 8, a fabric may be woven according to the weave chart shown in FIG. 9 with yarns selected as follows:

| | |
|---|---|
| weft monofilament yarns 92 | 0.22 mm polyamide |
| weft multifilament yarns 96 | 8 × .10 mm polyamide |
| weft monofilament yarns 98 | 0.15 mm polyamide |
| weft monofilament yarns 102 | 0.17 mm polyamide |
| warp monofilament yarns 104 | 0.17 mm polyester |
| warp monofilament yarns 106 | 0.17 mm polyester |
| | (56 ends/cm total) |

Embodiment 6

Figure 10:
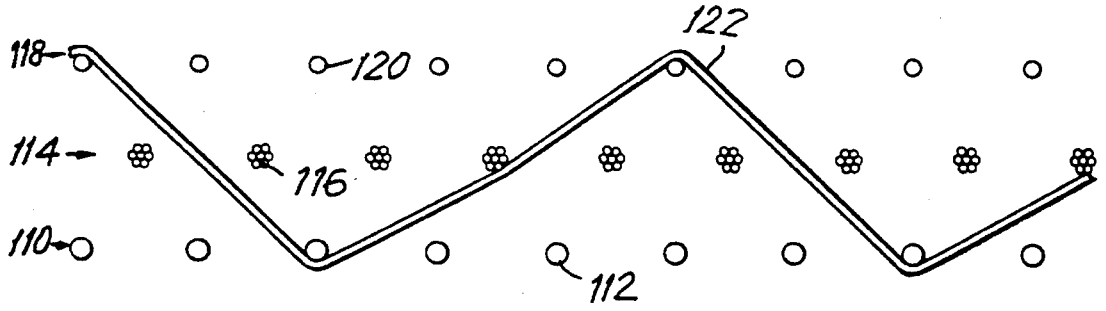
FIG. 10 is a longitudinal cross-section of a sixth embodiment of the present invention, wherein said cross-section has been taken along line X—X in FIG. 11.

A sixth embodiment of the present invention is illustrated in longitudinal cross-section in FIG. 10. The press fabric shown there comprises three layers of weft yarns interwoven with one system of warp yarns. The bottom layer 110 comprises monofilament yarns 112. The middle layer 114 comprises multifilament yarns 116. The top, or paper-contacting, layer 118 comprises monofilament yarns 120.

Monofilament yarns 120 of the top layer 118 and monofilament yarns 112 of the bottom layer 110 are in a vertically stacked relationship with one another through the thickness of the fabric, and therefore are provided in equal numbers on each of these two layers. Multifilament yarns 116 of the middle layer 114 are positioned in a staggered fashion substantially half way between each vertically stacked pair of monofilament yarns 120 of the top layer 118 and monofilament yarns 112 of the bottom layer 110.

The fabric is woven in a 5-shed weave as illustrated in FIG. 10 by characteristic warp yarn 122. In any given repeat of the weave pattern, warp yarn 122 passes over one weft yarn 120 of the top layer 118, then passes obliquely downward through the middle layer 114 to weave under the second monofilament yarn 112 of the bottom layer 110, then passes obliquely upward again through the middle layer 114 to weave over the third monofilament yarn 120 of the top layer 118 to repeat the pattern. In short, warp yarn 112 weaves over every fifth weft yarn 120 of the top layer 118 and under every fifth weft yarn 112 of the bottom layer 110.

FIG. 11 is a weave chart for the embodiment shown in FIG. 10, which is a cross-sectional view taken along line X—X thereof. As before, the letters "o" indicate those points where a warp yarn weaves under a weft yarn 112 of the bottom layer 110.

For a specific example of the embodiment shown in FIG. 10, a fabric may be woven according to the weave chart shown in FIG. 11 with yarns selected as follows:

| | |
|---|---|
| weft monofilament yarns 112 | 0.25 mm polyamide |
| weft multifilament yarns 116 | 8 × .10 mm polyamide |
| weft monofilament yarns 120 | 0.20 mm polyamide |
| warp monofilament yarns 122 | 0.20 mm polyester (28 ends/cm) |

Embodiment 7

Figure 12:
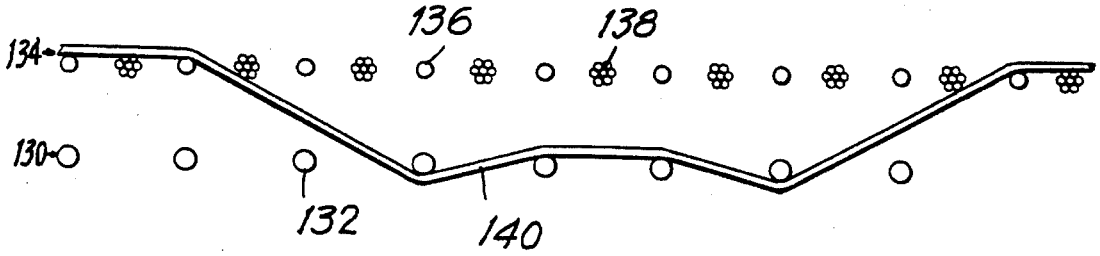
FIG. 12 is a longitudinal cross-section of a seventh embodiment of the present invention.

A seventh embodiment of the present invention is illustrated in longitudinal cross-section in FIG. 12. This seventh embodiment may be viewed as a variation of the second embodiment, discussed above and illustrated in longitudinal cross-section in FIG. 3.

The press fabric shown in cross-section in FIG. 12 comprises two layers of weft yarns interwoven with one system of warp yarns. The bottom layer 130 comprises monofilament yarns 132. The top, or paper-contacting, layer 134 comprises monofilament yarns 136 and multifilament yarns 138, which alternate with one another.

Monofilament yarns 136 of the top layer 134 and monofilament yarns 132 of the bottom layer 130 are in a vertically stacked relationship with one another through the thickness of the fabric, and therefore are provided in equal numbers on each layer. Multifilament yarns 138 of the top layer 134 alternate with monofilament yarns 136, providing the top layer 134 with twice as many weft yarns as the bottom layer 130.

The fabric is woven in an 8-shed weave as illustrated in FIG. 12 by characteristic warp yarn 140. In any given repeat of the weave pattern, warp yarn 140 passes over two consecutive weft yarns 136 of the top layer 134, then passes obliquely downward between the next stacked pair of monofilament yarn 136 of the top layer 134 and monofilament yarn 132 of the bottom layer 130, under the following monofilament yarn 132 of the bottom layer 130, over the next two and under the following monofilament yarn 132 of the bottom layer 130, then passes obliquely upward between the next stacked pair of monofilament yarn 136 of the top layer 134 and monofilament yarn 132 of the bottom layer 130 to weave over the next two consecutive weft yarns 136 of the top layer 134, thereby beginning the pattern anew.

For a specific example of the embodiment shown in FIG. 12, a fabric may be woven with yarns selected as follows:

| | |
|---|---|
| weft monofilament yarns 132 | .30 mm polyamide |
| weft monofilament yarns 136 | .17 mm polyamide |
| weft multifilament yarns 138 | 8 × .10 mm polyamide |
| warp monofilament yarns 140 | .17 mm polyamide (56 ends/cm) |

This seventh embodiment may be seamed more readily and quickly than the second embodiment, shown in FIG. 3.

Figure 13:
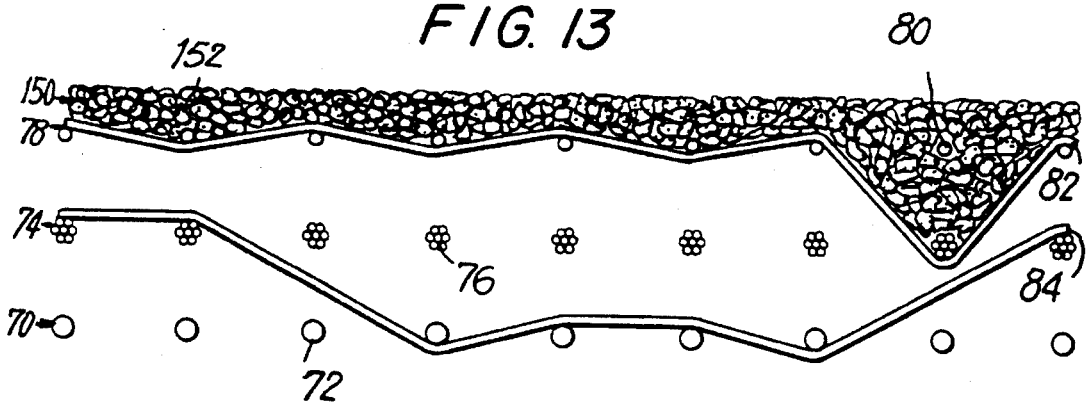
FIG. 13 is a longitudinal cross-section of the fourth embodiment of the present invention, previously shown in FIG. 7, having a coating of a polymeric resin material on the top, or paper-contacting, layer.
Figure 14:
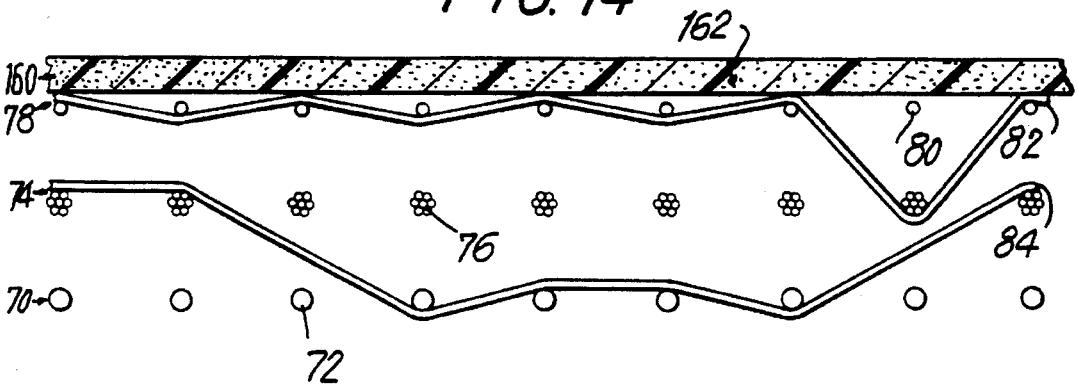
FIG. 14 is a longitudinal cross-section of the fourth embodiment of the present invention, having a layer of polymeric resin foam on the top, or paper-contacting, layer.
Figure 15:
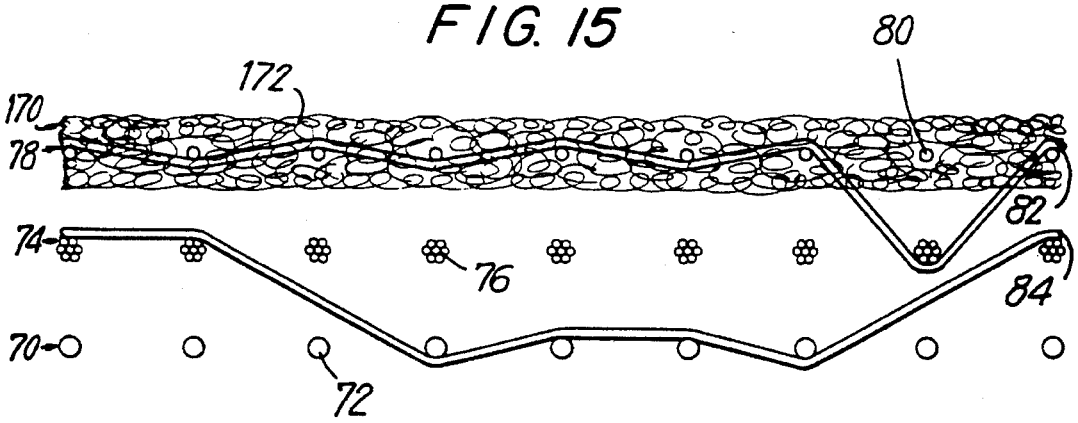
FIG. 15 is a longitudinal cross-section of the fourth embodiment of the present invention, having a batt of fibrous material needled into the top, or paper-coating, layer.

FIGS. 13 through 15, for the purpose of illustration, show longitudinal cross-sections of the fourth embodiment of the present invention, previously shown in FIG. 7, wherein the top, or paper-contacting, layer 78 has been modified by coating, lamination or needling.

Specifically, in FIG. 13, the top layer 78 has been coated with a layer 150 of polymeric resin particles 152, which may be obtained by chopping sheets of polyurethane into small particles of a substantially uniform size. The polymeric resin particles 152 are then applied to the top layer 78 in a layer 150 of uniform thickness, and secured thereto by exposure to an infra-red heat source.

In FIG. 14, a layer 160 of polymeric resin foam 162 is attached to the top, or paper-contacting, layer 78. In place of polymeric resin foam 162, other non-woven materials could be attached to the top layer 78 in a similar manner.

FIG. 15 depicts the embodiment of FIG. 7 wherein a layer 170 of fibrous batt 172 has been needled into the top layer 78 in a manner well known in the art.

As would be immediately apparent to one skilled in the art, it is possible to weave variations of the fabrics according to the preceding embodiments without departing from the scope of the present invention. For example, the fourth and fifth embodiments may be combined to produce a fabric having a middle layer wherein two thirds of the weft yarn are multifilament yarns. In such a case, every third yarn of the middle layer would be a monofilament yarn used to bind the top layer of the fabric to the middle layer.

Figure 16:
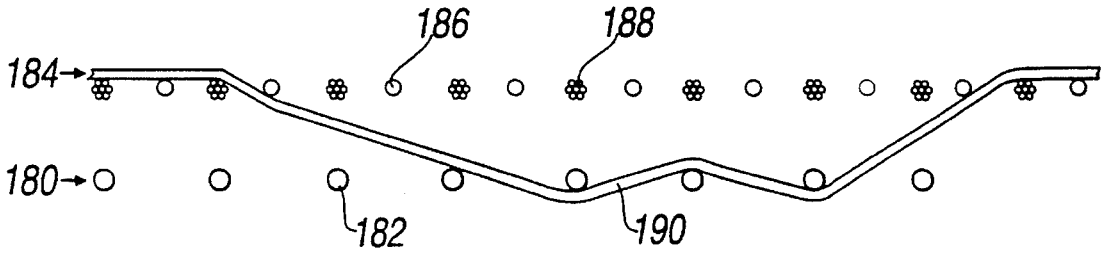
FIG. 16 is a longitudinal cross-section of a variation of the seventh embodiment of the present invention shown in FIG. 12.

For a further example, a variation of the seventh embodiment of the present invention is illustrated in longitudinal cross-section in FIG. 16.

The press fabric shown in cross-section in FIG. 16 comprises two layers of weft yarns interwoven with one system of warp yarns. The bottom layer 180 comprises monofilament yarns 182. The top, or paper-contacting, layer 184 comprises monofilament yarns 186 and multistrand yarns 188, which alternate with one another.

Multistrand yarns 188 of the top layer 184 and monofilament yarns 182 of the bottom layer 180 are in a vertically stacked relationship with one another through the thickness of the fabric, and therefore are provided in equal numbers on each layer. Monofilament yarns 186 of the top layer 184 alternate with multistrand yarns 188, providing the top layer 184 with twice as many weft yarns as the bottom layer 180.

The fabric is woven in an 8-shed weave as illustrated in FIG. 16 by characteristic warp yarn 190. In any given repeat of the weave pattern, warp yarn 190 passes over two consecutive weft yarns 188 of the top layer 184, then passes obliquely downward between the next two stacked pairs of multistrand yarns 188 of the top layer 184 and monofilament yarns 182 of the bottom layer 180, under the following monofilament yarn 182 of the bottom layer 180, over the next and under the following monofilament yarn 182 of the bottom layer 180, then passes obliquely upward between the next stacked pair of multistrand yarn 188 of the top layer 184 and monofilament yarn 182 of the bottom layer 180 to weave over the next two consecutive weft yarns 188 of the top layer 184, thereby beginning the pattern anew.

For a specific example of the embodiment shown in FIG. 16, a fabric may be woven with yarns selected as follows:

| | |
|---|---|
| weft monofilament yarns 182 | .50 mm polyamide |
| weft monofilament yarns 186 | .25 mm polyamide |
| weft multistrand yarns 188 | 8 × .10 mm polyamide |
| warp monofilament yarns 190 | .17 mm polyester (56 ends/cm) |

For another example of the embodiment shown in FIG. 16, a fabric may be woven with yarns selected as follows:

| | |
|---|---|
| weft monofilament yarns 182 | .40 mm polyamide |
| weft monofilament yarns 186 | .20 mm polyamide |
| weft multistrand yarns 188 | 8 × .10 mm polyamide |
| warp monofilament yarns 190 | .27 mm polyester (56 ends/cm) |

In any event, modifications, such as this, would be obvious to those skilled in the art, and would not bring the press fabric so modified beyond the scope of the appended claims.

What is claimed is:

1. A press fabric for the press section of a papermachine, said press fabric having a multilayer, compressible, resilient structure, said press fabric comprising:

a plurality of layers of weft yarns, said plurality being at most three, only one of said plurality of layers including multicomponent yarns, said multicomponent yarns having a plurality of load-bearing members, the remaining weft yarns in all of said plurality of layers being monofilament yarns, and one of said plurality of layers being a bottom layer, the weft yarns in said bottom layer including monofilament yarns of greater diameter than monofilament yarns in any other one of said plurality of layers; and a single system of warp yarns, said warp yarns being monofilament yarns, said warp yarns of said single system being interwoven with said weft yarns of all of said plurality of layers of weft yarns in a repeating pattern, so that said press fabric may be provided with an extremely fine paper-contacting surface, an open non-paper-contacting surface, and a structure having adequate void volume to store water pressed from a paper sheet.

2. A press fabric as claimed in claim 1 wherein said monofilament weft yarns are polyamide yarns.

3. A press fabric as claimed in claim 1 wherein said multicomponent weft yarns are polyamide yarns.

4. A press fabric as claimed in claim 1 wherein said warp yarns are selected from the group consisting of polyester and polyamide yarns.

5. A press fabric as claimed in claim 1 wherein said multicomponent yarns are multifilament yarns.

6. A press fabric as claimed in claim 5 wherein said multifilament yarns are polyurethane-coated.

7. A press fabric as claimed in claim 1 wherein said multicomponent yarns are polyurethane-coated monofilament yarns.

8. A press fabric as claimed in claim 1 wherein said multicomponent yarns are multistrand yarns.

9. A press fabric as claimed in claim 8 wherein said multistrand yarns are polyurethane-coated.

10. A press fabric as claimed in claim 1, said press fabric being woven endless.

11. A press fabric as claimed in claim 1, said press fabric being open-ended and seamable into closed form with a pintle.

12. A press fabric as claimed in claim 1, said press fabric being woven open-ended and joined into endless form with a woven marking-free seam prior to installation on a papermachine.

13. A press fabric as claimed in claim 1 further comprising a coating of a polymeric resin material on said paper-contacting surface thereof.

14. A press fabric as claimed in claim 1 further comprising a layer of polymeric resin foam or other non-woven material secured to said paper-contacting surface thereof.

15. A press fabric as claimed in claim 1 further comprising a batt of fibrous material needled into said paper-contacting surface thereof.

16. A press fabric as claimed in claim 1, said plurality of layers of weft yarns being three of said layers, said layers being a top layer, a middle layer, and a bottom layer.

17. A press fabric as claimed in claim 16 wherein said weft yarns of said top layer of weft yarns are all multicomponent yarns.

18. A press fabric as claimed in claim 16 wherein said weft yarns of said top layer of weft yarns include multicomponent yarns and monofilament yarns arranged in a pattern with respect to each other.

19. A press fabric as claimed in claim 16 wherein said weft yarns of said middle layer of weft yarns are all multicomponent yarns.

20. A press fabric as claimed in claim 16 wherein said weft yarns of said middle layer of weft yarns include multicomponent yarns and monofilament yarns arranged in a pattern with respect to each other.

21. A press fabric as claimed in claim 16 wherein equal numbers of weft yarns are in each of said top, middle, and bottom layers of the press fabric.

22. A press fabric as claimed in claim 16 wherein there are two weft yarns in said top layer of weft yarns for every one weft yarn in said middle layer of weft yarns.

23. A press fabric as claimed in claim 16 wherein weft yarns in said top layer of weft yarns, weft yarns in said middle layer of weft yarns, and weft yarns in said bottom layer of weft yarns are in a vertically stacked relationship.

24. A press fabric as claimed in claim 16 wherein weft yarns in said top layer of weft yarns, and weft yarns in said bottom layer of weft yarns are in a vertically stacked relationship.

25. A press fabric for the press section of a papermachine, said press fabric having a multilayer, compressible, resilient structure, said press fabric comprising:

a plurality of layers of weft yarns, said plurality being at most three, only one of said plurality of layers including multicomponent yarns, said multicomponent yarns having a plurality of load-bearing members, the remaining weft yarns in all of said plurality of layers being monofilament yarns, and one of said plurality of layers being a bottom layer, the weft yarns in said bottom layer including monofilament yarns of greater diameter than monofilament yarns in any other one of said plurality of layers;

a first system of warp yarns, said warp yarns being monofilament yarns, said warp yarns of said first system being interwoven with said weft yarns of said plurality of layers of weft yarns in a repeating pattern, so that said press fabric may be provided with an extremely fine paper-contacting surface, an open non-paper-contacting surface, and a structure having adequate void volume to store water pressed from a paper sheet; wherein said plurality of layers of weft yarns is three of said layers, said layers being a top layer, a middle layer, and a bottom layer; and a second system of warp yarns, said warp yarns being monofilament yarns, wherein said warp yarns of said first system weave with said weft yarns of said top layer in a repeating plain-weave pattern and bind said top layer to said middle layer by weaving with selected weft yarns of said middle layer, and wherein said warp yarns of said second system weave with said weft yarns of said middle layer and with said weft yarns of said bottom layer in a repeating pattern to form a duplex weave therebetween.

26. A press fabric as claimed in claim 25 wherein said warp yarns of said second system are selected from the group consisting of polyester and polyamide yarns.

27. A press fabric as claimed in claim 25 wherein said weft yarns of said middle layer of weft yarns include multicomponent yarns and monofilament yarns arranged in a pattern with respect to each other, and wherein said warp yarns of said first system weave with selected monofilament yarns of said weft yarns of said middle layer when binding said top layer to said middle layer.

28. A press fabric for the press section of a papermachine, said press fabric having a multilayer, compressible, resilient structure, said press fabric comprising:

a plurality of layers of weft yarns, only one of said plurality of layers including multicomponent yarns, said layer of weft yarns including multicomponent yarns not being a top, paper-contacting layer of weft yarns, said multicomponent yarns having a plurality of load-bearing members, the remaining weft yarns in all of said plurality of layers being monofilament yarns, and one of said plurality of layers being a bottom layer, the weft yarns in said bottom layer including monofilament yarns of greater diameter than monofilament yarns in any other one of said plurality of layers; and a single system of warp yarns, said warp yarns being monofilament yarns, said warp yarns of said single system being interwoven with said weft yarns of all of said plurality of layers of weft yarns in a repeating pattern, so that said press fabric may be provided with an extremely fine paper-contacting surface, an open non-paper-contacting surface, and a structure having adequate void volume to store water pressed from a paper sheet.

29. A press fabric as claimed in claim 28 wherein said monofilament weft yarns are polyamide yarns.

30. A press fabric as claimed in claim 28 wherein said multicomponent weft yarns are polyamide yarns.

31. A press fabric as claimed in claim 28 wherein said warp yarns are selected from the group consisting of polyester and polyamide yarns.

32. A press fabric as claimed in claim 28 wherein said multicomponent yarns are multifilament yarns.

33. A press fabric as claimed in claim 32 wherein said multifilament yarns are polyurethane-coated.

34. A press fabric as claimed in claim 28 wherein said multicomponent yarns are polyurethane-coated monofilament yarns.

35. A press fabric as claimed in claim 28 wherein said multicomponent yarns are multistrand yarns.

36. A press fabric as claimed in claim 35 wherein said multistrand yarns are polyurethane-coated.

37. A press fabric as claimed in claim 28, said press fabric being woven endless.

38. A press fabric as claimed in claim 28, said press fabric being open-ended and seamable into closed form with a pintle.

39. A press fabric as claimed in claim 28, said press fabric being woven open-ended and joined into endless form with a woven marking-free seam prior to installation on a papermachine.

40. A press fabric as claimed in claim 28 further comprising a coating of a polymeric resin material on said paper-contacting surface thereof.

41. A press fabric as claimed in claim 28 further comprising a layer of polymeric resin foam or other non-woven material secured to said paper-contacting surface thereof.

42. A press fabric as claimed in claim 28 further comprising a batt of fibrous material needled into said paper-contacting surface thereof.

43. A press fabric as claimed in claim 28, said plurality of layers of weft yarns being three of said layers, said layers being a top layer, a middle layer, and a bottom layer.

44. A press fabric as claimed in claim 43 wherein said weft yarns of said middle layer of weft yarns are all multicomponent yarns.

45. A press fabric as claimed in claim 43 wherein said weft yarns of said middle layer of weft yarns include multicomponent yarns and monofilament yarns arranged in a pattern with respect to each other.

46. A press fabric as claimed in claim 43 wherein equal numbers of weft yarns are in each of said top, middle, and bottom layers of the press fabric.

47. A press fabric as claimed in claim 43 wherein there are two weft yarns in said top layer of weft yarns for every one weft yarn in said middle layer of weft yarns.

48. A press fabric as claimed in claim 43 wherein weft yarns in said top layer of weft yarns, weft yarns in said middle layer of weft yarns, and weft yarns in said bottom layer of weft yarns are in a vertically stacked relationship.

49. A press fabric as claimed in claim 43 wherein weft yarns in said top layer of weft yarns, and weft yarns in said bottom layer of weft yarns are in a vertically stacked relationship.

50. A press fabric for the press section of a papermachine, said press fabric having a multilayer, compressible, resilient structure, said press fabric comprising:

a plurality of layers of weft yarns, only one of said plurality of layers including multicomponent yarns, said layer of weft yarns including multicomponent yarns not being a top, paper-contacting layer of weft yarns, said multicomponent yarns having a plurality of load-bearing members, the remaining weft yarns in all of said plurality of layers being monofilament yarns, and one of said plurality of layers being a bottom layer, the weft yarns in said bottom layer including monofilament yarns of greater diameter than monofilament yarns in any other one of said plurality of layers;

a first system of warp yarns, said warp yarns being monofilament yarns, said warp yarns of said first system being interwoven with said weft yarns of said plurality of layers of weft yarns in a repeating pattern, so that said press fabric may be provided with an extremely fine paper-contacting surface, an open non-paper-contacting surface, and a structure having adequate void volume to store water pressed from a paper sheet; wherein said plurality of layers of weft yarns is three of said layers, said layers being a top layer, a middle layer, and a bottom layer; and a second system of warp yarns, said warp yarns being monofilament yarns, wherein said warp yarns of said first system weave with said weft yarns of said top layer in a repeating plain-weave pattern and bind said top layer to said middle layer by weaving with selected weft yarns of said middle layer, and wherein said warp yarns of said second system weave with said weft yarns of said middle layer and with said weft yarns of said bottom layer in a repeating pattern to form a duplex weave therebetween.

51. A press fabric as claimed in claim 50 wherein said warp yarns of said second system are selected from the group consisting of polyester and polyamide yarns.

52. A press fabric as claimed in claim 50 wherein said weft yarns of said middle layer of weft yarns include multicomponent yarns and monofilament yarns arranged in a pattern with respect to each other, and wherein said warp yarns of said first system weave with selected monofilament yarns of said weft yarns of said middle layer when binding said top layer to said middle layer.

53. A press fabric for the press section of a papermachine, said press fabric having a multilayer, compressible, resilient structure, said press fabric comprising:

two layers of weft yarns, said layers being a top layer and a bottom layer, one of said two layers including multicomponent yarns, said multicomponent yarns having a plurality of load-bearing members, the remaining weft yarns in both of said layers being monofilament yarns; and a system of warp yarns, said warp yarns being monofilament yarns interwoven with said weft yarns of said two layers of weft yarns in a repeating pattern, so that said press fabric may be provided with an extremely fine paper-contacting surface, an open non-paper-contacting surface, and a structure having adequate void volume to store water pressed from a paper sheet.

54. A press fabric as claimed in claim 53 wherein said weft yarns of said top layer of weft yarns include multicomponent yarns and monofilament yarns arranged in a pattern with respect to each other.

55. A press fabric as claimed in claim 53 wherein there are two weft yarns in said top layer of weft yarns for every one weft yarn in said bottom layer of weft yarns.

56. A press fabric as claimed in claim 53 wherein at least some of said weft yarns in said top layer are in a vertically stacked relationship with said weft yarns in said bottom layer.

57. A press fabric as claimed in claim 53 wherein said monofilament weft yarns in said bottom layer are of greater diameter than said monofilament weft yarns in said top layer.

58. A press fabric as claimed in claim 55 wherein said multicomponent yarns are in said top layer of weft yarns and wherein said monofilament yarns alternate with said multicomponent yarns in said top layer.

59. A press fabric as claimed in claim 58 wherein said multicomponent yarns in said top layer of weft yarns are in a vertically stacked relationship with said monofilament yarns in said bottom layer.

60. A press fabric as claimed in claim 58 wherein said monofilament yarns in said top layer of weft yarns are in a vertically stacked relationship with said monofilament yarns in said bottom layer.

* * * * *